United States Patent [19]

Ziegelmann

[11] 4,128,228

[45] Dec. 5, 1978

[54] EXTENSION LADDER HOIST

[76] Inventor: Frank E. Ziegelmann, P.O. Box 99 Station A, Auburn, Calif. 95603

[21] Appl. No.: 805,236

[22] Filed: Jun. 9, 1977

[51] Int. Cl.[2] ..... B66C 23/60

[52] U.S. Cl. ..... 254/139.1; 182/101; 187/11

[58] Field of Search ..... 254/139.1, 142, 186 HC, 254/186 R, 190 R; 182/103, 117, 142, 129, 101, 102; 187/11, 12, 9 R

[56] References Cited

U.S. PATENT DOCUMENTS

| | | | |
|---|---|---|---|
| 731,708 | 6/1903 | Quinn | 182/102 |
| 921,431 | 5/1909 | Miller | 182/101 |
| 1,086,601 | 2/1914 | Mangel | 182/103 |
| 2,069,607 | 2/1937 | Gaw | 182/103 |
| 2,714,434 | 8/1955 | Peterson | 182/103 |
| 3,115,211 | 12/1963 | Ostrander, Jr. | 182/103 |
| 3,222,034 | 12/1965 | Jackson | 254/139.1 |

FOREIGN PATENT DOCUMENTS

| | | | |
|---|---|---|---|
| 288324 | 6/1964 | Australia | 182/117 |
| 80079 | 10/1955 | Denmark | 254/142 |
| 624193 | 11/1926 | France | 254/142 |
| 354701 | 6/1929 | United Kingdom | 182/103 |

*Primary Examiner*—Trygve M. Blix
*Assistant Examiner*—Kenneth Noland
*Attorney, Agent, or Firm*—Blair, Brown & Kreten

[57] ABSTRACT

A support having a hoist for raising and lowering articles from one elevation to another in which one portion of the support is a ladder.

5 Claims, 8 Drawing Figures

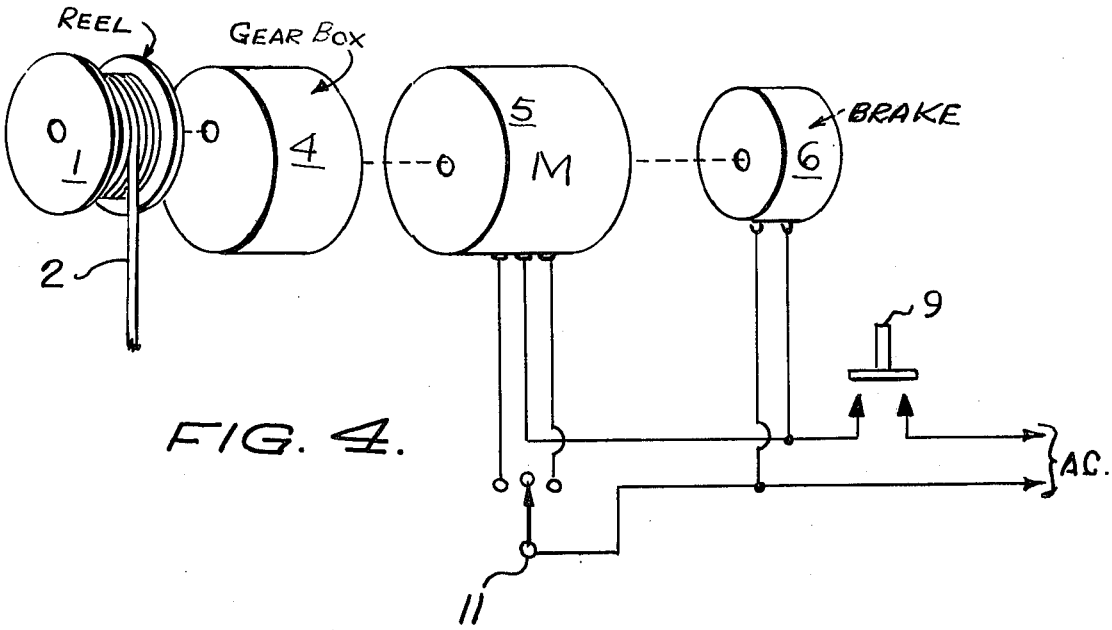
FIG. 4.
FIG. 5.
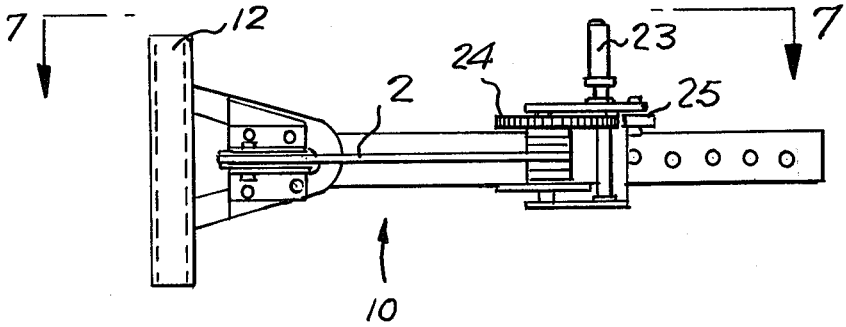
FIG. 6.
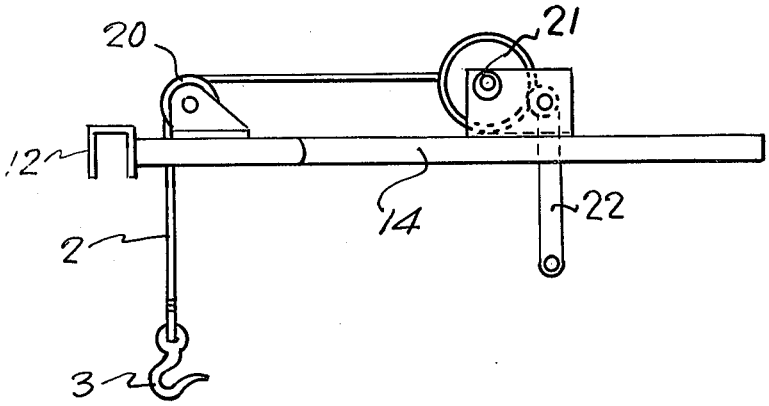

EXTENSION LADDER HOIST

BACKGROUND OF THE INVENTION

1. Field of the Invention

Difficulty associated with transporting heavy objects from one elevation to another along the outer face of a building has been appreciated for some time.

Prior art devices which include outriggers for transporting fairly heavy objects have the difficulty that an additional structure might be assembled to provide this lifting operation. These outrigger and pulley systems have been found to be unwieldy and cumbersome, and they themselves provide a substantial degree of difficulty in elevating them to the working station.

2. Summary of the Invention

Accordingly a lightweight and portable mechanism which can be elevated with minimal difficulty can provide a substantial improvement over the state of the art.

Furthermore a mechanism of the character described above which requires no additional assembly and is a component of the ladder which a person would use to get to the top of a building can provide additional structural stability for the ladder as well minimize the total number of components needed to be carried to the top of the roof.

OBJECT OF THE INVENTION

Accordingly it is an object of this invention to provide a hoist mechanism which can be attached to a conventional ladder to provide transferral of objects from one elevation to another.

It is also an object of this invention to provide a hoisting mechanism which increases the structural stability of the ladder. It is also an object of this invention to provide a hoist mechanism which is carried on a unitized frame to avoid unnecessary assembly of outriggers and the like which serve the same purpose.

Other objects and advantages will become apparent in the following specification when considered in light of the attached drawings.

BRIEF DESCRIPTION OF THE FIGURES

FIG. 4 shows a schematic of the components and their inter-relationship;

FIG. 5 shows an alternative embodiment from a top view;

FIG. 6 is a side view of the embodiment shown in FIG. 5;

DESCRIPTION OF THE PREFERRED EMBODIMENT

Figure 1:
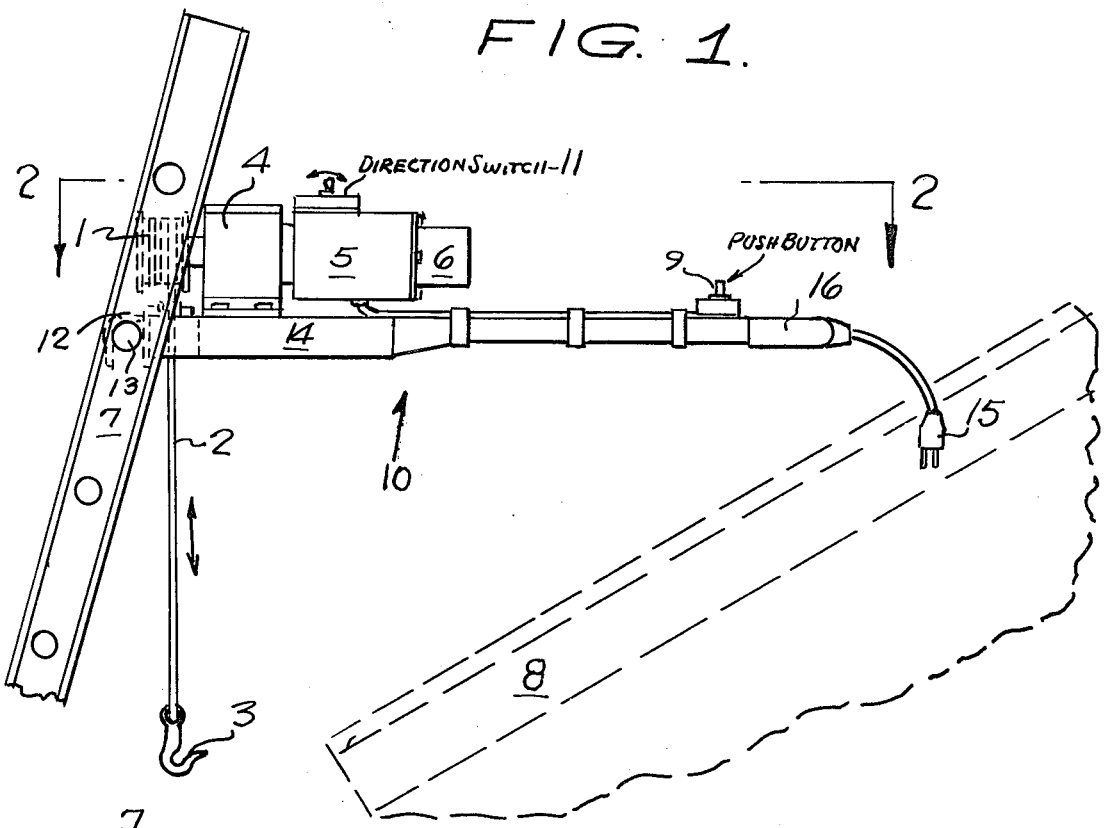
FIG. 1 shows a side view of the hoist mechanism.

Referring to the drawings now, in which like numerals refer to like parts throughout the drawings, the general hoist mechanism as shown in the figures is denoted by the numeral 10.

Figure 2:
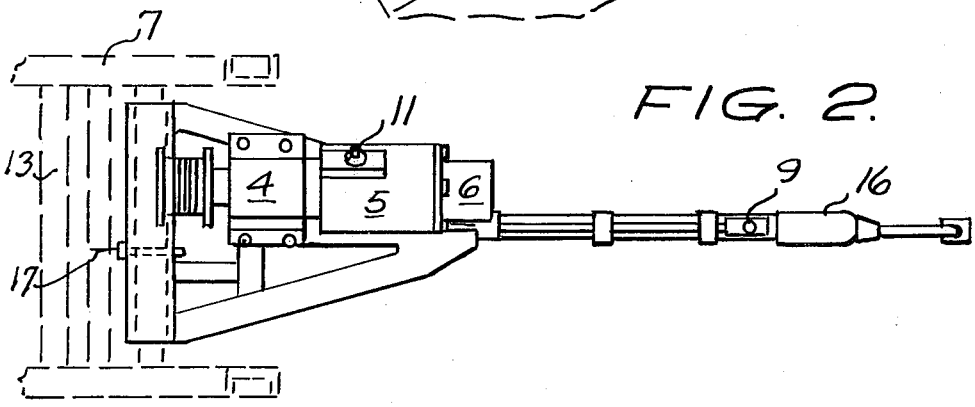
FIG. 2 is a top view thereof.
Figure 3:
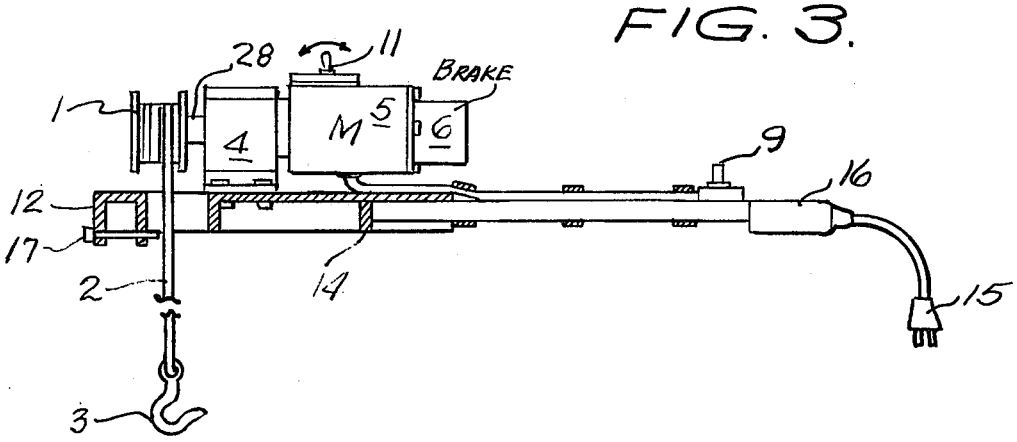
FIG. 3 shows a side view having cut away portions and with the ladder removed.

FIGS. 1, 2 and 3 show top and side views of the extension ladder hoist that is power operated. Frame 14 of hoist 10 supports a motor 5 which is attached to gear train 4 at one extremity and a brake at the other. Attached to the gear 4 through shaft 28 is a winch 1 upon which cable or rope 2 is wound. Depending from rope 2 is a retention hook 3. The extremity of frame 14 near winch 1 is a U-shaped channel 12 which is cause to overlie a rung 13 of an extension ladder 7. Means to secure the channel member 12 on said rung include a pin retainer 17 which underlies the rung and is inserted through openings in the channel member 12.

FIG. 4 schematically details the operation of the automatic hoist depicted in FIGS. 1 through 3 and it will be noted that direction switch 11 is associated with motor 5 to select the direction the motor will turn. The switch has three positions off, up and down. The motor is connected to an AC outlet through plug member 15 and interposed between the plug and the direction switch is a push button control 9 which serves as a deadman switch. That is to say when the switch is in the free state as shown in FIG. 4 the brake 6 is automatically energized. With the three positions switch as detailed above and the push button activation switch the following modes of operation are possible. With the three position switch in the up position, you can hoist a load up. In the down position you can power lower a load down. In the brake position the brake only is energized and the load can be lowered slowly by using the drag friction of the gear train when the control switch 9 is pushed down. When switch 9 is released the brake causes the load to stop immediately and the load is held by the brake.

Figure 7:
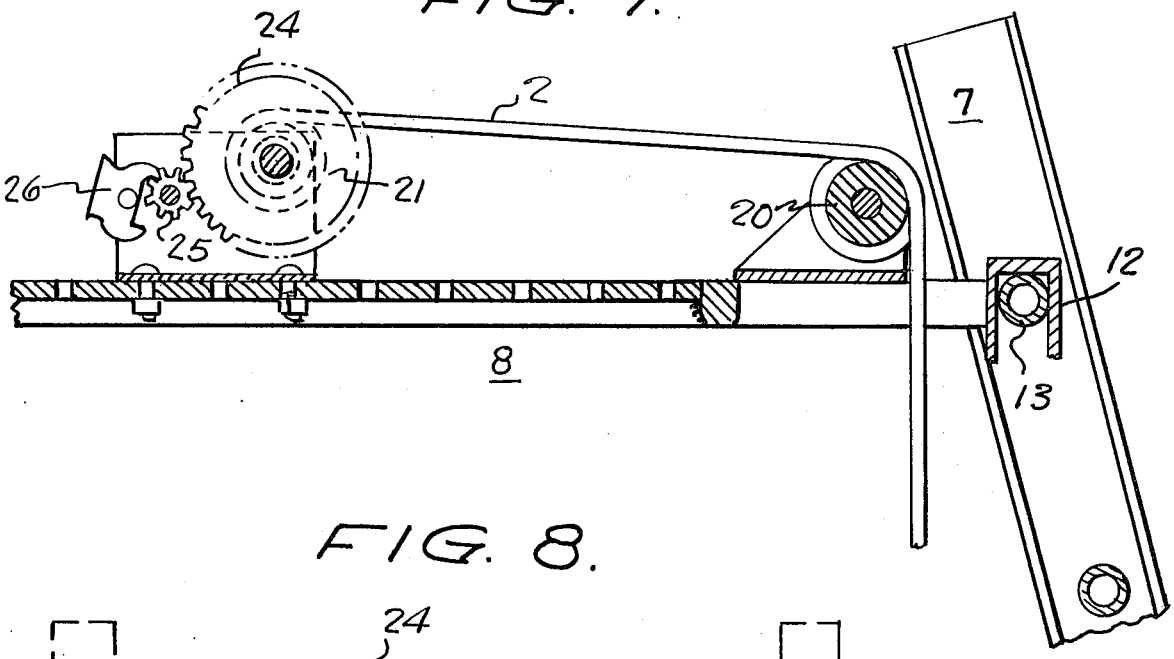
FIG. 7 is an alternative side view having cut away portions showing the engagement of the hoist and the ladder.
Figure 8:
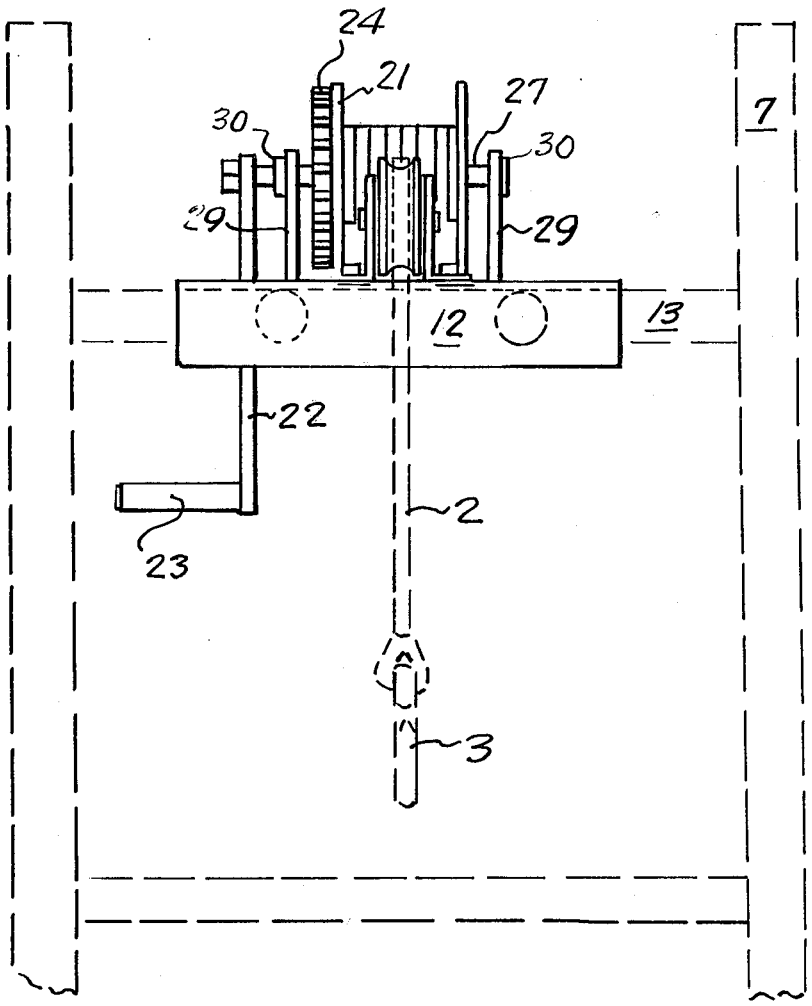
FIG. 8 is an end view of the embodiments shown in FIGS. 5, 6 and 7.

FIGS. 5 through 8 show an alternative embodiment in which the actual hoisting operation is done through direct gearing and a crank manually. As in the previous embodiment the ladder and frame member rest on roof 8 and frame 14 is retained on the ladder through channel members 12 over rung 13 of the ladder in a similar fashion. Although not shown, the locking means depicted by numeral 17 of FIG. 3 it is capable of being used in this system as well. The rope or cable 2 is supported at the edge of the building by means of pulley 20 which transfers the motion from a vertical direction to a horizontal one. The rope 2 is wound on drum or winch 21 which is rotatably supported on axle 27 through bearings 30 on frame 29. Axle 27 terminates in lever 22 on one side and lever 22 extends to a hand crank 23. FIG. 7 shows a detailed side view of the gearing mechanism used in this manual hoist and it is seen that gear 24 which is disposed on drum 21 cooperates with gear 25 and locking member 26 to provide a positive means for braking and retaining the load which is disposed on hook 3 of cable 2 at any intermediate position.

Having thus described the preferred embodiments of the invention it should be understood that numerous structural modifications and adaptations may be resorted to without departing from the spirit of the invention.

What is claimed is:

1. A hoist for use with an extension ladder comprising a frame member interposed between said extension ladder and a roof at an upper extremity of said extension ladder so that said upper extremity of said extension ladder is removed from said roof and supported on said roof solely by said frame member through a U-shaped channel on said frame which overlies a rung on the ladder and further includes a locking pin extending through the channel and underlying said rung; a winch disposed on said frame, a cable disposed on said winch having a portion which extends vertically downward between said extension ladder and said roof; and means to wind said cable on said winch disposed on said frame so as to raise and lower a terminal portion of said cable from said upper extremity of said extension ladder to a lower extremity; said means to wind said cable includes a motor connected to said winch through a gear and a shaft, a brake connected to said motor to constrain said motor from motion when the brake is applied, a power source connected to said motor, control means to direct the action of the motor and brake.

2. The device of claim 1 in which said control means comprises a three position switch to regulate the motor's upward and downward motion, and a further switch which when activated allows the motor to turn, and when said further switch is deactivated energizes said brake.

3. The device of claim 1 in which said means to wind the cable comprises a pulley mounted on said frame upon which said cable rides to change the direction of travel of said rope from vertical to horizontal, gear means connected to said winch to provide a brake for said winch, and a hand crank connected to said winch to rotate said winch and thereby deploy the cable on said winch.

4. The hoist of claim 3 in which said gear means comprises a first gear connected to said winch, a second gear meshed to said first gear and a locking member engageable with said second gear to hold said winch.

5. The hoist of claim 1 in which the frame member defines a substantially triangular portion proximate to said extension ladder which terminates into a substantially linear handle portion proximate to said roof.

* * * * *